United States Patent [19]

Hellier

[11] 4,264,280

[45] Apr. 28, 1981

[54] WATER VAPOR RELEASING COMPOSITION OF MATTER AND DEVICE, AND PROCESS FOR THEIR USE

[75] Inventor: Stephen J. Hellier, Milan, Italy

[73] Assignee: S.A.E.S. Getters S.p.A., Milan, Italy

[21] Appl. No.: 813,302

[22] Filed: Jul. 6, 1977

Related U.S. Application Data

[62] Division of Ser. No. 556,929, Mar. 10, 1975, Pat. No. 4,066,309.

[30] Foreign Application Priority Data

Mar. 12, 1974 [IT] Italy ..... 86232 A/74

[51] Int. Cl.[3] ..... F04B 37/02

[52] U.S. Cl. ..... 417/51; 252/181.1

[58] Field of Search ..... 252/181.1, 181.7, 181.2, 252/181.6; 417/48, 51; 228/115, 116; 29/420; 75/208 R

[56] References Cited

U.S. PATENT DOCUMENTS

| | | | |
|---|---|---|---|
| 1,952,717 | 3/1934 | Lederer | 252/181.7 |
| 2,791,715 | 5/1957 | Heins | 313/174 X |
| 3,669,567 | 6/1972 | Porta et al. | 417/48 |
| 3,719,433 | 3/1973 | Rabusin | 417/48 |
| 3,722,976 | 3/1973 | Porta et al. | 316/3 |
| 3,927,953 | 12/1975 | Zucchinelli | 417/48 |

FOREIGN PATENT DOCUMENTS

| | | | |
|---|---|---|---|
| 237549 | 9/1960 | Australia | 417/48 |

OTHER PUBLICATIONS

Encyclopedia of Chemical Technology, pp. 640–646, by R. E. Kirk et al.

*Primary Examiner*—Carlton R. Croyle
*Assistant Examiner*—Edward Look
*Attorney, Agent, or Firm*—David R. Murphy

[57] ABSTRACT

A device for releasing water vapor in electron tubes comprises a holder and a water vapor releasing material carried by said holder. In one embodiment the water vapor releasing material is a hydroxide or hydrated oxide of a metallic element in combination with a binder. In another embodiment it is hydrated alumina.

9 Claims, 10 Drawing Figures

WATER VAPOR RELEASING COMPOSITION OF MATTER AND DEVICE, AND PROCESS FOR THEIR USE

This is a divisional of application Ser. No. 556,929, filed Mar. 10, 1976, which is now U.S. Pat. No. 4,066,309.

BACKGROUND OF THE INVENTION

During the manufacture of electron tubes the electrode assembly and tube envelope are heated to elevated temperatures in order to degas the internal components and surfaces. This degassing, or baking, takes place while the electron tube is being evacuated, or under pumping. After conversion and activation of the cathode of the electron tube it is sealed off from the pumping system and a getter device within the electron tube is activated to make it capable of sorbing the residual gases during the life of the electron tube. Some of these latter stages may however take place in a slightly different order.

It is known that the residual gas atmosphere during and after tube processing can later affect the properties of the tube.

It has been found that there can be a beneficial effect on tube life and performance if water vapor is introduced into the electron tube during its manufacture or processing. Kanellopoulos (U.S. Pat. No. 3,589,791) proposes the use of a sponge soaked in water, allowing atmospheric air drawn through the sponge to cause water vapor to enter a kinescope as it cools down after a fritsealing process. Such processes are tiresome, however, as they require the additional steps of placing and removing the sponge in the neck of the kinescope. Furthermore excess water often has to be removed. The sponge may become soiled with the risk of introducing extraneous material within the tube. If the sponge is discarded the process may become relatively costly. As the amount of water contained in the sponge is not easily controllable it does not produce a reproducible quantity of moisture within the electron tube.

Using a sponge also means that during the vacuum baking stage the moisture previously introduced may be completely removed during the initial part of the baking cycle which leads to less beneficial effects on the cathode during the final processing stages.

Another known method is by the use of calcium hydroxide in a rupturable container. However, calcium hydroxide has not proved altogether satisfactory. Furthermore, the use of a rupturable container is awkward.

Barium hydroxide and zirconium hydroxide have also been suggested.

It is therefore an object of the present invention to overcome one or more of the disadvantages of prior means of introducing water vapor into electron tubes.

Another object of the presente invention is to provide a water vapor releasing composition of matter and device capable of releasing water vapor during the processing of an electron tube.

A further object of the present invention is to provide a water vapor releasing composition of matter and device capable of releasing a first part of its water content during baking of the electron tube and a second part of its water content at temperatures higher than those encountered in tube bakeout.

Yet a further object of the present invention is to provide an improved method of processing an electron tube.

Further objects and advantages of the present invention will become obvious to those skilled in the art by reference to the following description and drawings wherein.

Figure 1:
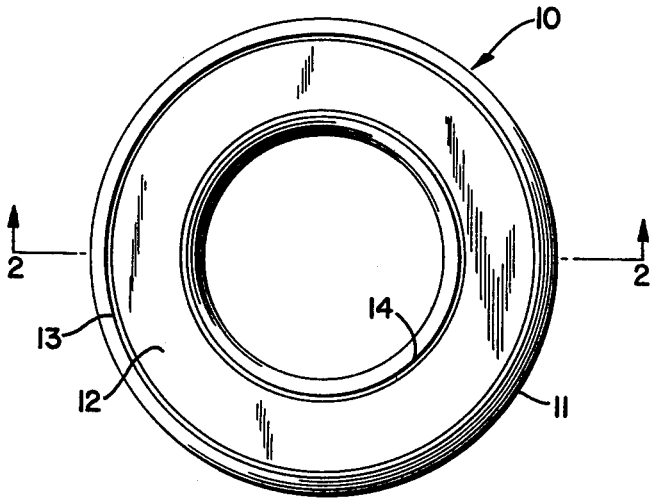
FIG. 1 is a representation of a water vapor releasing device of the present invention.

According to the present invention there is provided a composition of matter, a device and a process capable of releasing moisture vapor during the manufacture of an electron tube.

According to one aspect of the present invention there is provided a water vapor releasing composition comprising (A) a particulate hydrated oxide or hydroxide of Ir, Cd, Ni, Zr, Ti, Al, Ba and/or Mg and mixtures thereof and (B) a binder.

According to another aspect of the present invention it has been discovered that hydrated alumina is a particularly good water vapor releasing material with or without the use of the above binder.

The preferred water vapor releasing materials are those materials which are stable in air at ambient temperatures and which release water vapor at the baking temperatures of electron tubes.

More preferred water vapor releasing materials are those materials which are stable at room temperature in air and which release only a first part of their available water content in vacuum at the baking temperatures and baking times used during manufacture of electron tubes but which release also a second part of their water content in vacuum at temperatures higher than those encountered in tube bakeout.

The most preferred group of materials are the hydroxides of metals comprising $Ir(OH)_4$; $Cd(OH)_2$; $Ni(OH)_2$; $Zr(OH)_4$; $Al(OH)_3$; $Zr(OH)_2$; $Ba(OH)_2$; and $Mg(OH)_2$. Hydrated alumina in general and $Al(OH)_3$ in particular are the most preferred water vapor releasing materials as they have a low cost, are not poisonous, are stable in air and are easily handleable.

On heating $Al(OH)_3$ up to about 400° C., the usual bakeout temperature of electron tubes, it is found that over a period of about ½ hour almost 75–80% of the theoretical water content is evolved, whereas to extract the remaining water content it is necessary to heat the material to much higher temperatures. However at these higher temperatures the remaining water content is evolved in only a very short time of a few seconds.

The water vapor generating material may be introduced into the electron tube in any form suitable for allowing the evaporation of water vapor.

The water vapor generating material can be employed in any suitable physical form but is preferably employed as a finely divided particulate solid such as one passing through a standard screen of 40 mesh per inch and preferably that passing through a screen of 120 mesh per inch and being retained on a screen of 600 mesh per inch.

The water vapor generating material in powder form may be mixed with any suitable binder. Non-metallic binders may be used such as silicate binders. The binder may itself be a powdered material which does not react with water vapor. Metal powders are particularly suitable as binders as upon compression the metal particles cold weld to each other forming a porous matrix containing the water vapor releasing material in such a manner that there are no loose particles. Examples of suitable binders are Ni, Fe, Co, mixtures thereof and alloys thereof.

The binder is generally employed as fine particles which pass through a screen of 325 mesh and preferably those particles which pass through a screen of 600 mesh per inch.

The use of metallic binders also ensures a more even and quicker distribution of heat throughout the water vapor releasing material which has poor heat conducting properties.

The water vapor releasing material may be mixed with the binder in any suitable weight ratio. Preferred weight ratios are from 50:1 to 1:50 and more preferably from 20:1 to 1:20 (releasing material:binder). At much higher weight ratios of releasing material to binder there is insufficient binder to hold the mass together in a compact mass. At lower ratios there is insufficient water vapor releasing material to evaporate the amount of vapor required.

In one embodiment the water vapor releasing powder is pressed into the cavity of an annular ring holder which is closed by another annular ring of smaller size whereas in another embodiment the vapor releasing powder in admixture with a binder is pressed into a small open capsule holder.

In a further embodiment the holder is in the form of a wire or rod around which is formed a pill or pellet of the water vapor releasing material.

The present invention is applicable to a wide variety of electron tubes such as transmitting tubes and kinescopes, power tubes, display tubes.

Figure 2:
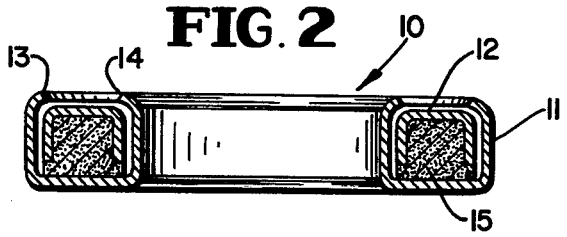
FIG. 2 is a cross-sectional view taken along line 2—2 of FIG. 1.

Referring now to the drawings and in particular to FIGS. 1 and 2 there is shown a water vapor releasing device 10 comprising an outer annular ring holder 11 and an inner annular ring holder 12. Upper edges 13 and 14 of outer ring holder 11 are bent to form a fixing means for inverted inner ring holder 12. Water vapor releasing material 15 is enclosed between ring holders 11 and 12.

Figure 3:
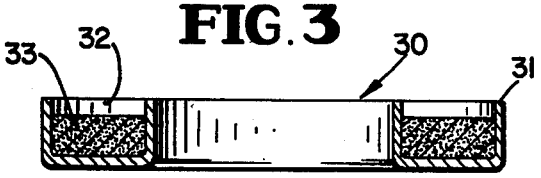
FIG. 3 is a further representation of a water vapor releasing device of the present invention.

Referring now to FIG. 3 there is shown a water vapor releasing device 30 in which the holder is in the form of an annular ring 31 having a cavity 32 wherein is held a mixture 33 of a water vapor releasing material and a binder.

Figure 4:
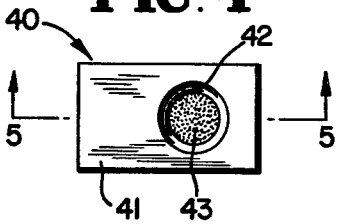
FIG. 4 is a plan view of another water vapor releasing device of the present invention.
Figure 5:
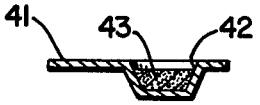
FIG. 5 is a sectional view along line 5—5 of FIG. 4.

FIGS. 4 and 5 show a water vapor releasing device 40 in which the holder 41 is in the form of a sheet in which has been formed a depression 42 in which is compressed a mixture 43 of water vapor releasing material and a binder.

Figure 6:
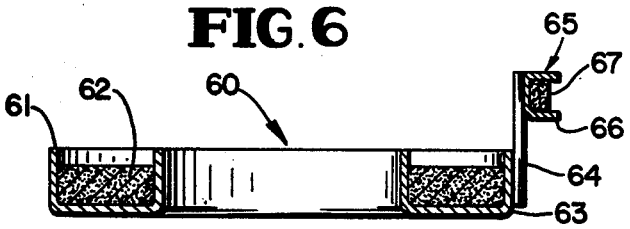
FIGS. 6 and 7 are representations of water vapor releasing devices of the present invention being used in conjunction with evaporable getter devices.

FIG. 6 shows a getter device 60 comprising an annular shaped holder 61 supporting an evaporable getter material 62. To outer wall 63 of getter device 60 there is attached a wire 64. Wire 64 supports a water vapor releasing device 65 comprising a cup 66 in which there is compressed a mixture 67 of water vapor releasing material and a binder.

Figure 7:
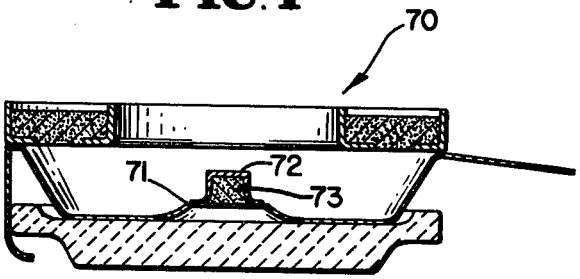

FIG. 7 shows a getter device 70 as described in U.S. Pat. No. 3,381,805. To coupling element 71 is attached in thermal contact a cup 72 holding a mixture 73 of water vapor releasing material and a binder.

Figure 8:
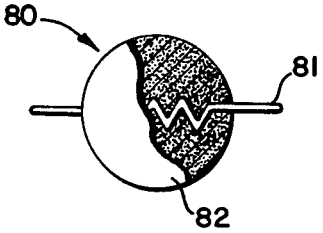
FIG. 8 is a further view in cross section of a water vapor releasing device of the present invention.

FIG. 8 shows a water vapor releasing device 80 in the form of a pellet in which the holder 81 is in the form if a wire of high electrical resistance having a mixture 82 of a water vapor releasing material and a binder compressed around it.

Figure 9:
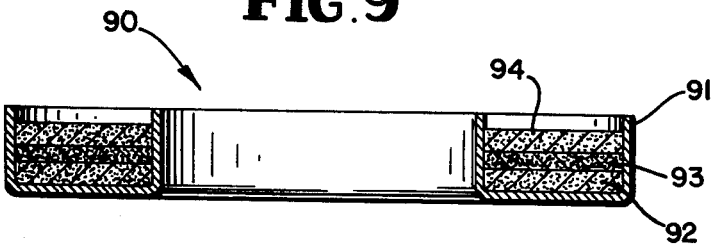
FIGS. 9 and 10 are further representations of water vapor releasing devices of the present invention being used in conjunction with evaporable getter material.

FIG. 9 shows a water vapor generating device 90 comprising an annular ring holder 91 in which there is placed a first layer 92 of evaporable getter material, a layer 93 of water vapor releasing material, and a second layer 94 of evaporable getter material. Layer 93 may be of only water vapor releasing material or it may be a mixture of water vapor releasing material and a binder. It can also include an evaporable getter material.

Figure 10:
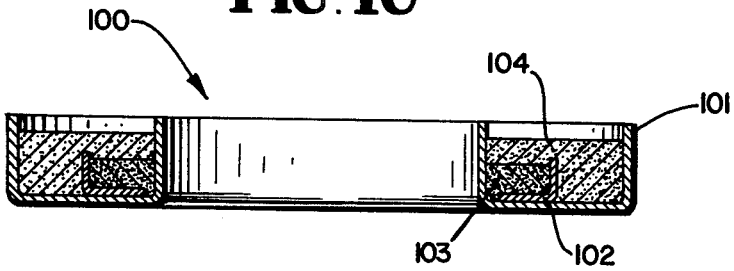

FIG. 10 shows a water vapor generating device 100 comprising an annular ring holder 101 in which is placed a reinforcing ring 102. Within reinforcing ring 102 is placed water vapor releasing material 103 and then the annular ring 101 is filled with evaporable getter material 104 so that the water vapor releasing material 103 is covered.

According to another aspect of the invention there is provided an improved method for manufacturing an electron tube comprising the steps of inserting into the tube a water vapor releasing material preferably by means of one of the above-described devices and then baking the tube so that the water vapor releasing material releases at least part of its water vapor content.

An important feature of the present invention is that in some preferred embodiments the water vapor releasing device can be further heated, if desired, to a higher temperature thus causing the water vapor releasing material to release a further part of its water vapor content.

The invention is further illustrated by the following examples in which all parts and percentages are in weight unless otherwise indicated. These non-limiting examples are illustrative of certain embodiments designed to teach those skilled in the art how to practice the invention and to represent the best mode contemplated for carrying out the invention.

EXAMPLE 1

Particulate aluminum hydroxide, $Al(OH)_3$ which passes through a standard screen of 120 mesh per inch and is retained on a screen of 600 mesh per inch is taken. Sixty milligrams are placed in the u-shaped channel of an annular holder of stainless steel. Over this holder is placed a second annular holder with a slightly larger u-channel section such that the open part of the first channel is facing the closed part of the second channel. Upper edges of the second ring channel are then bent slightly so as to retain the first holder fixedly within the second channel. This device is mounted in an electron tube. The electron tube is baked at 400° C. for 30 minutes. The device releases more than 10 mg. of water vapor.

EXAMPLE 2

Example 1 is repeated except that after the bake the device is heated to 1000° C. for 15 seconds by induction heating. A further quantity of water vapor is released.

EXAMPLE 3

Particulate aluminum hydroxide, $Al(OH)_3$, which passes through a standard screen of 120 mesh per inch is mixed with particulate nickel which passes through a screen of 600 mesh per inch in a ratio of 1 part $Al(OH)_3$ to 5 parts of Ni. Two hundred milligrams of the mixture are pressed into a cylindrical holder of stainless steel 4 mm in diameter and 5 mm in height closed at one end. The cylindrical holder is attached to a getter device of the type described in U.S. Pat. No. 3,381,805. The attachment, by projection welding, is to the coupling element such that the axes of the getter device and the cylindrical holder are approximately co-extensive.

The getter device bearing the water vapor releasing device is mounted in the antenna position on the electron gun of a color television kinescope. The gun is mounted inside a glass kinescope provided with a shadow mask and phosphors in the normal way. The kinescope is evacuated and baked at 400° C. for 30 minutes. The water vapor releasing device releases water vapor. The cathodes of the electron gun are converted and activated and the kinescope is tipped off. The getter device is flashed by induction heating, towards the end of evaporation of the getter material a further quantity of water vapor is evolved from the water vapor releasing device.

Although the invention has been described in considerable detail with reference to certain preferred embodiments thereof, it will be understood that variations and modifications can be effected within the spirit and scope of the invention as described above and as defined in the appended claims.

What is claimed is:

1. A water vapor generating device for use in electron tubes comprising a holder and a water vapor generating composition carried by the holder wherein the water generating composition comprises:

(A) a particulate hydrated oxide or a particulate hydroxide of a metal chosen from the group consisting of Ir, Cd, Ni, Zr, Ti, Al, Ba and Mg and (B) a particulate metal whose particles cold weld together on the application of compressive forces wherein the weight ratios of A:B is from 50:1 to 1:50.

2. A water vapor releasing device of claim 1 in which the holder is in the form of an annular ring of U-shaped cross section.

3. A water vapor releasing device of claim 1 in which the holder is in the form of a hollow cylinder closed at one end.

4. A water vapor releasing device of claim 1 in which the holder is in the form of a wire or rod.

5. A water vapor releasing device of claim 1 in which the holder is in thermal contact with a getter device.

6. A water vapor generating device for use in electron tubes comprising a holder and a water vapor generating composition carried by the holder wherein the water generating composition comprises:

(A) a particulate hydrated oxide or a particulate hydroxide of a metal chosen from the group consisting of Ir, Cd, Ni, Zr, Ti, Al, Ba and Mg and (B) a particulate metal whose particles cold weld together on the application of compressive forces chosen from the group consisting of Fe, Co and Ni wherein the weight ratio of A:B is from 50:1 to 1:50.

7. A water vapor generating device for use in electron tubes comprising a holder and a water vapor generating composition carried by the holder wherein the water generating composition comprises:

(A) particulate $Al(OH)_3$ (B) particulate Ni wherein the weight ratio of A:B is from 25:1 to 1:25.

8. A water vapor generating device for use in electron tubes comprising a holder and a water vapor generating composition carried by the holder wherein the water generating composition comprises:

(A) particulate $Al(OH)_3$ which passes through a screen of 120 mesh per inch (B) particulate Ni which passes through a screen of 600 mesh per inch wherein the weight ratio of A:B is from 25:1 to 1:25.

9. A water vapor releasing device for use in a television kinescope comprising a hollow metallic cylinder closed at one end and a water vapor generating composition of matter carried by the holder wherein the water generating composition comprises:

(A) particulate $Al(OH)_3$ which passes through a screen of 120 mesh per inch (B) particulate Ni which passes through a screen of 600 mesh per inch wherein the weight ratio of A:B is from 25:1 to 1:25 and the holder is in thermal contact with a getter device.

* * * * *